US005261140A

United States Patent [19]

Szymanski

[11] Patent Number: 5,261,140

[45] Date of Patent: Nov. 16, 1993

[54] REVERSIBLE ROTARY SHAMPOO MACHINE OR FLOOR WAXER

[76] Inventor: Thomas A. Szymanski, 101-26 98th St., Ozone Park, N.Y. 11416

[21] Appl. No.: 930,271

[22] Filed: Aug. 14, 1992

[51] Int. Cl.[5] ..... A47L 11/162; A47L 11/40

[52] U.S. Cl. ..... 15/50.1; 15/49.1; 15/98; 15/DIG. 10; 200/43.17; 200/61.85; 200/334

[58] Field of Search ..... 15/49.1, 50.1, 98, DIG. 10; 200/43.17, 332.2, 334, 61.85, 43.01, 505; 51/177

[56] References Cited

U.S. PATENT DOCUMENTS 3,398,250 8/1968 Bowers ..... 200/332.2

4,174,473 11/1979 Brenneman ..... 200/332.2

*Primary Examiner*—Edward L. Roberts

*Attorney, Agent, or Firm*—Richard L. Miller

[57] ABSTRACT

A reversible rotary shampoo machine or floor waxer is provided which consists of a reversible motor and a reversing switch having a safety off position electrically connected in a circuit to the reversible motor, with the reversing switch mechanically interlocked to the on/off switch so that the on/off switch must turn off the motor before the reversing switch is permitted to change the direction of rotation of the reversible motor, in order to prevent damage to the reversible motor, or accidental injury to an operator.

2 Claims, 1 Drawing Sheet

REVERSIBLE ROTARY SHAMPOO MACHINE OR FLOOR WAXER

BACKGROUND OF THE INVENTION

The instant invention relates generally to rotatable brush machinery and more specifically it relates to a reversible rotary shampoo machine or floor waxer.

Numerous rotatable brush machines have been provided in the prior art that are adapted to be utilized for cleaning various items, such as teeth, rugs, carpet and the like. For example, U.S. Pat. Nos. 3,553,758 to Wood; 3,875,605 to Fegan and 4,267,617 to Brown et al. all are illustrative of such prior art. While these units may be suitable for the particular purpose to which they address, they would not be as suitable for the purpose of the present invention as hereafter described.

SUMMARY OF THE INVENTION

A primary object of the present invention is to provide a reversible rotary shampoo machine or floor waxer that will overcome the shortcomings of the prior art devices.

Another object is to provide a reversible rotary shampoo machine or floor waxer in which a reversing switch is connected to a motor to permit changing the scrubbing/polishing member rotation from a clockwise direction to a counterclockwise direction, in order to achieve better utilization of the rotary brush.

An additional object is to provide a reversible rotary shampoo machine or floor waxer in which the reversing switch has a built in safety feature which requires the device to be switched to a stop position before the device is switched to change the motor direction of rotation, so as to eliminate damage to the motor, accidental injury to the operator thereof.

A further object is to provide a reversible rotary shampoo machine or floor waxer that is simple and easy to use.

A still further object is to provide a reversible rotary shampoo machine or floor waxer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
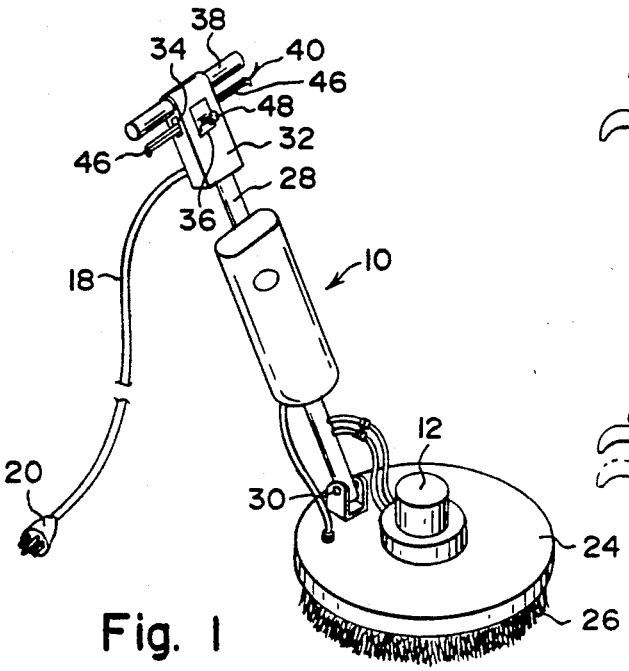
FIG. 1 is a diagrammatic perspective view of a rotary shampoo machine illustrating the instant invention installed thereon.
Figure 2:
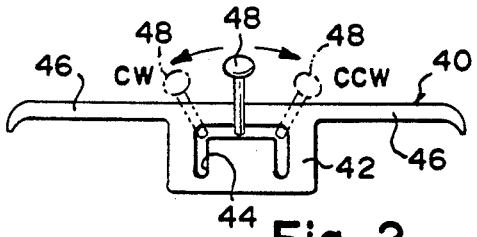
FIG. 2 is a diagrammatic front view of a first embodiment of the instant invention.
Figure 3:
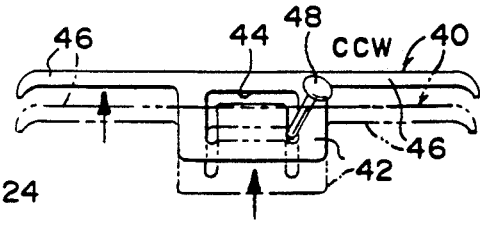
FIG. 3 is a diagrammatic front view thereof illustrating the relative movement between parts.

Turning now descriptively to the drawings, in which similar reference characters denote similar elements throughout the several views, the Figures illustrate a reversible rotary shampoo machine or floor waxer 10, which consists of a reversible motor 12 and a reversing switch 14 having a safety off position electrically connected in a circuit 16 to the reversible motor 12. The reversing switch 14 will turn the reversible motor 12 off before changing the direction of rotation of the reversible motor 12, to prevent damage to the reversible motor 12, or accidental injury to the operator.

A power cord 18 is electrically connected to the circuit 16, while a plug 20 is on a distal end of the power cord 18 to engage with an electrical wall socket (not shown) to bring a source of power into the circuit 16. An on/off switch 22 is electrically connected to the circuit 16 between the power cord 18 and the reversing switch 14. The on/off switch 22 is mechanically interlocked with the reversing switch 14 so that the on/off switch 22 can only turn on the reversible motor 12 when the reversing switch 14 is not in the safety off position. The reversible rotary shampoo machine or floor waxer 10 further includes a lower housing 24 for supporting the reversible motor 12 thereon. A scrubbing/polishing member 26 is positioned under the lower housing 24 and is rotatively driven by the reversible motor 12. The scrubbing/polishing member 26 is adapted to contact a surface to be cleaned/polished. An elongated handle 28 is pivotally mounted at a bottom end 30 to the lower housing 24 and extends upwardly therefrom. An upper housing 32 is affixed to a top end of the elongated handle 28. The upper housing 32 has a pair of side apertures 34 and a front aperture 36, while a handle grip 38 is transversely secured to a top portion of the upper housing 32. An on/off switch lever 40 has a body portion 42 with an inverted U-shaped slot 44 therein and a pair of arms 46. Each arm 46 extends sidewardly through one side aperture 34 in the upper housing 32. A reversing switch lever 48 extends forwardly through the inverted U-shaped slot 44 in the body 42 of the on/off switch lever 40 and the front aperture 36 in the upper housing 32. Typically in the inverted U-shaped slot 44 the right side can be for a counterclockwise rotation of the motor 12, the left side can be for a clockwise rotation of the motor 12 and the center can be for the safety off position for the motor 12. The arms 46 of the on/off switch lever 40 can be pulled towards the handle grip 38 to turn on the on/off switch 22 only when the reversing switch lever 48 is not in the center safety off position.

Figure 4:
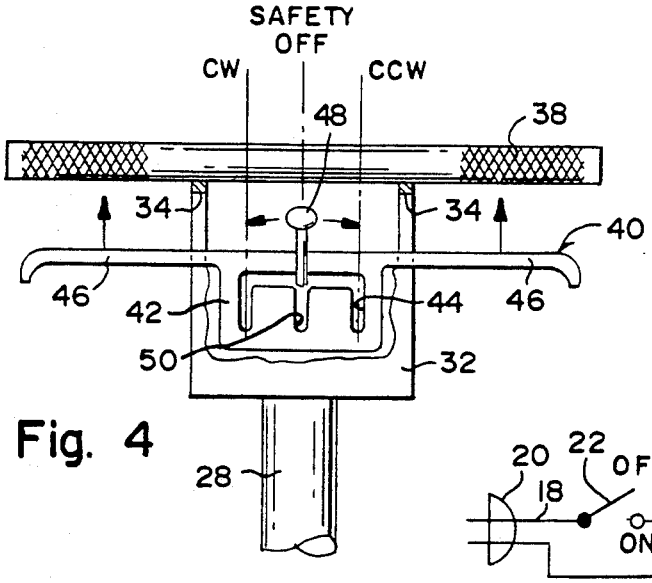
FIG. 4 is a diagrammatic front view of a second embodiment of the instant invention.
Figure 5:
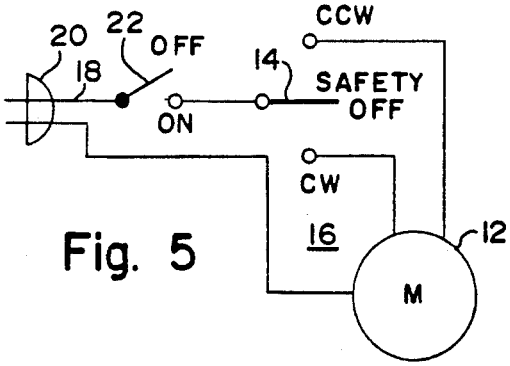
FIG. 5 is an electrical schematic diagram thereof.

In FIG. 4, the inverted U-shaped slot 44 in the body portion 42 of the on/off switch lever 40 has an additional center vertical slot 50. When the reversing switch lever 48 is placed in the center vertical slot 50, the reversing switch 14 will be kept in the safety off position even if the on/off switch lever 40 is pulled upwardly towards the handle grip 38. The center vertical slot 50 prevents the reversing switch lever 48 from accidently going to one side of the inverted U-shaped slot 44.

To use the reversible rotary shampoo machine or floor waxer 10, a person simply places the reversing switch lever 48 to the right or left side of the inverted U-shaped slot 44. The on/off switch lever 40 can now be pulled towards the handle grip 38 to start the motor 12. To reverse the direction of the motor 12, the on/off switch lever 40 must be released to allow the reversing switch lever 48 to be moved to a different position. If the reversing switch lever 48 is in the middle safety off position, the motor 12 will not operate, even if the on/-off switch lever 40 is pulled towards the handle grip 38.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A reversible rotary shampoo machine or floor waxer which comprises:

a) a reversible motor;

b) a reversing switch having a safety off position electrically connected in a circuit of said reversible motor, and mechanical interlocking means requiring that an on/off switch will turn said reversible motor off before permitting changing the direction of rotation of said reversible motor, to prevent damage to said reversible motor, accidental injury to an operator;

c) a power cord electrically connected to the circuit;

d) a plug on a distal end of said power cord to engage with an electrical wall socket to bring a source of power into the circuit;

e) said on/off switch electrically connected to the circuit between said power cord and said reversing switch, whereby said on/off switch can only turn on said reversible motor when said reversing switch is not in the safety off position;

f) a lower housing for supporting said reversible motor thereon;

g) a scrubbing/polishing member positioned under said lower housing and rotatively driven by said reversible motor, said scrubbing/polishing member adapted to contact a surface to be cleaned/polished;

h) an elongated handle pivotally mounted at a bottom end to said lower housing and extending upwardly therefrom;

i) an upper housing affixed to a top end of said elongated handle, said upper housing having a pair of side apertures and a front aperture;

j) a handle grip transversely secured to a top portion of said upper housing;

k) an on/off switch lever in said upper housing, said on/off switch lever having a body portion with an inverted U-shaped slot therein and a pair of arms, each extending sidewardly through one side aperture in said upper housing; and l) a reversing switch lever extending forwardly through the inverted U-shaped slot in the body of said on/off switch lever and the front aperture in said upper housing, typically in the inverted U-shaped slot the right side can be for a counterclockwise rotation of said motor, the left side can be for a clockwise rotation of said motor and the center can be for the safety off position for said motor, whereby the arms of said on/off switch lever can be pulled towards said handle grip to turn on said on/off switch when said reversing switch lever is not in the center safety off position.

2. A reversible rotary shampoo machine or floor waxer as recited in claim 1, wherein the inverted U-shaped slot in the body portion of said on/off switch lever has an additional center vertical slot, so that when said reversing switch lever is placed in the center vertical slot, said reversing switch will be kept in the safety off position, even if said on/off switch lever is pulled upwardly towards said handle grip, thereby preventing said reversing switch lever from accidentally going to one side of the inverted U-shaped slot.

* * * * *